US005526248A

United States Patent [19]

Endo

[11] Patent Number: 5,526,248

[45] Date of Patent: Jun. 11, 1996

[54] PROJECTOR TYPE HEADLIGHT WITH COLOR-SUPPRESSION STRUCTURE

[75] Inventor: Ariyoshi Endo, Atsugi, Japan

[73] Assignee: Ichikoh Industries, Ltd., Tokyo, Japan

[21] Appl. No.: 369,396

[22] Filed: Jan. 6, 1995

[30] Foreign Application Priority Data

Jan. 11, 1994 [JP] Japan ..... 6-001173
Dec. 19, 1994 [JP] Japan ..... 6-314941

[51] Int. Cl.[6] ..... F21V 7/00

[52] U.S. Cl. ..... 362/297; 362/348; 362/61

[58] Field of Search ..... 362/61, 296, 297, 362/348, 344

[56] References Cited

U.S. PATENT DOCUMENTS

| | | | |
|---|---|---|---|
| 4,277,821 | 7/1981 | Sassmannshausen | 362/346 |
| 4,404,620 | 9/1983 | Takahashi et al. | 362/348 |
| 5,144,190 | 9/1992 | Thomas et al. | 362/296 |
| 5,180,218 | 1/1993 | Ohshio | 362/61 |

FOREIGN PATENT DOCUMENTS

| | | | |
|---|---|---|---|
| 5-14404 | 4/1993 | Japan . | |
| 395017 | 7/1933 | United Kingdom | 362/296 |
| 2254136 | 9/1992 | United Kingdom . | |

OTHER PUBLICATIONS

Patent Abstracts of Japan, vol. 18, No. 3, (E-1485), Jan. 6, 1994, abstract of Yoshiki et al., "Metal Halide Lamp", Japanese 52–51055, Sep. 28, 1993.

*Primary Examiner*—Carroll B. Dority
*Attorney, Agent, or Firm*—Foley & Lardner

[57] ABSTRACT

The improved projector type headlight according to the present invention comprises a reflector having two focuses, an HID bulb of which the discharging portion is located near the first one of the two focuses, and a convex lens which converges and projects rays of light emitted from the HID bulb and reflected by the reflector. Many fine concavities or convexities are formed over, or on a portion of, the effective reflecting area of the reflector. The HID bulb is advantageous in that it is small but provides a large amount of light. However, it emits locally colored rays light as will be evident from detailed observation of the discharging portion thereof. Such colored rays of light are appropriately scattered and mixed together due to reflection by the light diffusing surface having many fine concavities or convexities formed thereon, with the result that the reflected rays of light are almost whitened. Thus, the colored rays of light are little sensed by the human eyes. Furthermore, scattering of the rays of light enlarges the light distribution pattern of white rays of light and this pattern superposes on the colors around the illuminated area, thereby causing the colors to be less sensed by the human eyes.

3 Claims, 9 Drawing Sheets

PROJECTOR TYPE HEADLIGHT WITH COLOR-SUPPRESSION STRUCTURE

BACKGROUND OF THE INVENTION a) Field of the Invention

The present invention relates to a projector type headlight using an HID (high intensity discharge) bulb as light source, and more particularly to a projector type headlight designed to prevent a coloring caused by color components of the rays of light emitted from the HID bulb, that is, a colored vision of a white object illuminated with the rays of light from the HID bulb.

b) Prior Art Statement

The projector type headlight is small in size but can provide a high luminous flux density, so it has recently been used more and more widely. One of the latest projector type headlights is known from the disclosure in the Japanese Examined Utility Model Publication (Kokoku) No. 5-14404, for example. FIGS. 1(A) and 1(B) are attached hereto to explain the well-known projector type headlight technology. FIG. 1(A) is a schematic side elevation of a projector type headlight, and FIG. 1(B) shows a light distribution pattern of equiluminous curves defined, on a screen, by the rays of light from the projector type headlight.

As seen in FIG. 1(A), the projector type headlight comprises a reflector (of a spheroidal mirror, for example) 1 having two focuses F1 and F2, and a lamp bulb 2 at the first focus F1. Rays of light emitted from the lamp bulb 2 are reflected and converged by the reflector 1 toward the second focus F2. The rays of light thus converged at the second focus F2 are diffused and incident upon a beam-converging convex lens 3. Passing through the convex lens 3, the rays of light are refracted to be generally parallel to each other and projected forwardly of the headlight. There is provided near the second focus F2 a shade 4 to cut off a part of the rays of light passing by near the second focus F2, for thereby defining a light distribution pattern. The hatched part of the light distribution pattern shown in FIG. 1(B) is a shadow of the shade 4 projected as inverted vertically and horizontally. The edge of the shade shadow is called "cut line". The light distribution pattern shown in FIG. 1(B) is provided for theoretical explanation of the illumination of a road surface by a projector type headlight. If the light distribution pattern has such a characteristic as shown, the projector type headlight is suitably usable as an automobile headlight since the rays of light from the headlight illuminates the road surface in front of a car running on a lane (to the left of the V—V line) while it does not illuminate above the horizontal (H—H line) of the opposite lane without any possibility of dazzling the driver of a car running on that opposite lane (to the fight of the V—V line).

In the conventional projector type headlight shown in FIGS. 1(A) and (1B), a halogen lamp is commonly used as the lamp bulb 2, so the headlight can be designed small and provide a high luminous flux density as described in the foregoing. However, if an HID bulb is used as the lamp bulb 2, the projector type headlight can be designed smaller and provide a larger amount of light. But there is a problem that the rays of light from the HID bulb include color components (the driver will sense colors in the rays of light). FIG. 2 is an axial sectional view of the essential part of an HID bulb, schematically showing the buildup of a discharge arc light. There are defined along the shortest path between a pair of discharge electrodes 6*c* and 6*d* a zone a of central discharge arc, a zone b enclosing the zone a and a zone c of outer discharge arcs enclosing the zone b. In addition, a zone d is defined at each of the ends of the electrodes 6*c* and 6*d*. These zones differ in color from one another. FIG. 3 shows a distribution of wavelengths in the zones a to d in FIG. 2, in which the horizontal axis shows the wavelength with color scales. As evident from FIG. 3, the zone a of central discharge arc and the zone b defined around the zone a are sensed as white, the zone c of outer discharge arcs is as reddish colors and the zones d at the ends of the discharge electrodes 6*c* and 6*d* are as bluish colors. As a result, the light distribution pattern in FIG. 1(B) appears colored.

SUMMARY OF THE INVENTION

Accordingly, the present invention has an object to overcome the above-mentioned drawbacks of the prior art by providing a projector type headlight using an HID bulb as light source and which can illuminate road surface by a light distribution pattern with colors suppressed.

To accomplish the above object, the present invention uses the following two principles:

(a) When a light-colored light is superposed on a strong white light, the human eyes will sense no colors in them.

(b) When rays of light in different colors are mixed, an almost white color will result and thus the human eyes will sense no colors in the mixture.

The above two principles will be further described and the utilization thereof sequentially discussed herebelow.

Mixing the rays of light in reddish colors in the zone c with those in bluish colors in the zone d in FIG. 3 will whiten them almost completely. Further mixing of the rays of light in this nearly white color with the white rays of color in the zones a and b will cause them to be sensed by the human eyes as white rays of light.

Mixing of rays of light can be done in various ways. The present invention aims at providing a simplest, positive method for mixing of rays of light with less loss of light amount. To this end, many fine concavities or convexities are formed in a reflecting surface area contributing to definition of a predetermined light distribution pattern (the reflecting surface area will be referred to as "effective reflecting area" herebelow) so that the rays of light emitted from the HID bulb are appropriately scattered through reflection of them at the fine convexities or concavities in the effective reflecting area.

The above-mentioned scattering of the rays of light at many fine concavities or convexities formed in the effective reflecting area permits to appropriately diffuse the reflected rays of light. This diffusion can be utilized to widen the area illuminated with the strong white light as in (a) above, and the widened area be superposed on the light-colored rays of light to more positively assure a color suppression of the rays of light. The present invention is based on these principles.

According to an aspect of the present invention, a projector type headlight is provided which comprises a reflector having two focuses, an HID bulb of which the discharging portion is located near the first one of the reflector focuses, and a convex lens which converges and projects rays of light emitted from the HID bulb and reflected by the reflector, the reflector having many fine concavities or convexities formed in the effective reflecting area thereof.

According to another aspect of the present invention, a projector type headlight is provided which comprises a reflector having two focuses, and an HID bulb of which the discharging portion is located near the first one of the reflector focuses, to converge the rays of light from the HID bulb into a desired light distribution pattern, the reflector having many fine concavities or convexities formed in the substantially entire effective reflecting area thereof.

According to a yet another aspect of the present invention, a projector type headlight is provided which comprises a reflector having two focuses, an HID bulb of which the discharging portion is located near the first one of the reflector focuses, and a convex lens which converges rays of light emitted from the HID bulb and reflected by the reflector, the reflector having formed in the nearly entire effective reflecting area thereof many fine concavities or convexities having nearly a same reflectivity.

According to a still another aspect of the present invention, a projector type headlight is provided which comprises a reflector having two focuses, an HID bulb of which the discharging portion is located near the first one of the reflector focuses, and a convex lens which converges rays of light emitted from the HID bulb and reflected by the reflector, the reflector having formed in the center of the effective reflecting area thereof many fine concavities or convexities offering a diffusion and reflection of the rays of light.

In the projector type headlights according to the first and second aspects of the present invention, the many fine concavities or convexities formed in the effective reflecting area of the reflector serve to mix together the reflected rays of light by scattering, so that the coloring components included in the rays of light emitted from the HID bulb are suppressed for sensing as white light by the human eyes. This advantage is ensured for the projector type headlight without any sacrifice of the function of the headlight reflector. The reason will be described below in comparison with a conventional non-projector type headlight shown in FIG. 4. FIG. 4 is a sectional view of the conventional non-projector type headlight comprising a lamp bulb 12 disposed near the focus of a reflecting surface 10 like a paraboloid of revolution, and a prism lens 11 disposed perpendicular to the path of the rays of light reflected by the reflecting surface 10. Rays of light are emitted from the lamp bulb 12 as indicated with the arrows g and h, reflected by the reflecting surface 10 formed on the inner wall of a lamp housing 9 as indicated with the arrows g' and h', and converged by the prism lens 11 to define a predetermined light distribution pattern. Therefore, if fine convexities or concavities are formed on the reflecting surface 10, the rays of light are scattered by the convexities or concavities, so that no desired light distribution pattern can be defined.

In the projector type headlight shown in FIG. 1, the rays of light emitted from the lamp bulb 2 and reflected by the reflector 1 are partially cut off by the shade 4, and converged by, and projected through, the convex lens 3. Therefore, even if the rays of light emitted from the lamp bulb 2 under no control are scattered by the fine convexities or concavities formed on the reflecting surface of the reflector 1 at the step of reflection by the reflector 1, the shade 4 and convex lens 3 effectively work to define a desired light distribution pattern.

In the projector type headlights according to the third and fourth aspects of the present invention, the fine convexities or concavities formed in the effective reflecting area of the reflector effectively mix color components together, thereby suppressing the colors of the rays of light. Furthermore, since the nearly whole effective reflecting area of the reflector according to the third aspect of the present invention is made to diffuse the rays of light uniformly, colors of the rays of light are suppressed while a spot-like light distribution pattern (luminous intensity at the central portion thereof is considerably high), a feature of the projector type headlight, is being maintained. Also, since the illuminated area in the light distribution pattern is so enlarged as to enclose the colored zones, thereby more effectively suppressing the colors of the rays of light. The rear portion (that is, the central portion) of the effective reflecting area according to the present invention diffuses and reflects the rays of light more strongly. Since this central portion provides the high luminous intensity, the spot-like light distribution pattern is corrected to define a wide light distribution pattern. Although it cannot be said which one of the spot-like and wide light distribution patterns is more advantageous than the other, a variety of requirements for the headlights can be met by embodying the projector type headlight according to the third or fourth aspect of the present invention as selected depending upon given specifications.

DETAILED DESCRIPTION OF THE PREFERRED EMBODIMENTS

Figure 1A:
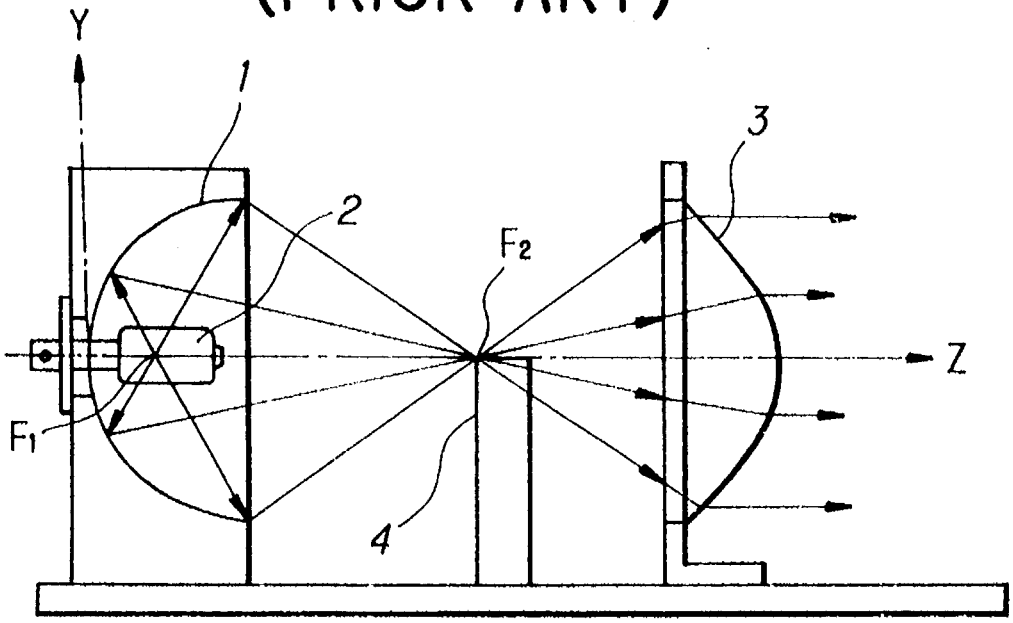
FIG. 1(A) (PRIOR ART)
FIGS. 1(A) and 1(B) are explanatory drawings of the well-known projector type headlight technology, FIG. 1(A) being a schematic side elevation of the projector type headlight and FIG. 1(B) being a group of equiluminous curves defined, on a screen, by rays of light from the conventional projector type headlight.
Figure 1B:
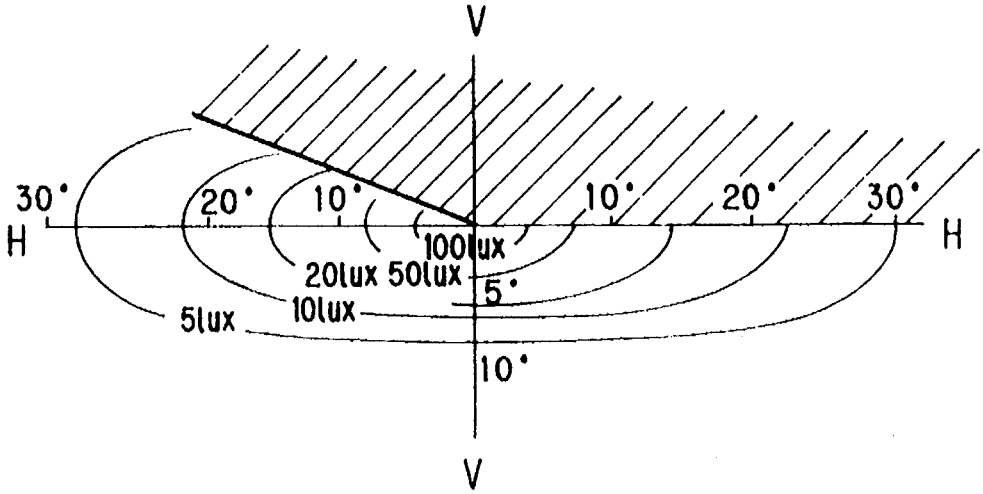
FIG. 1(B) (PRIOR ART)
Figure 2:
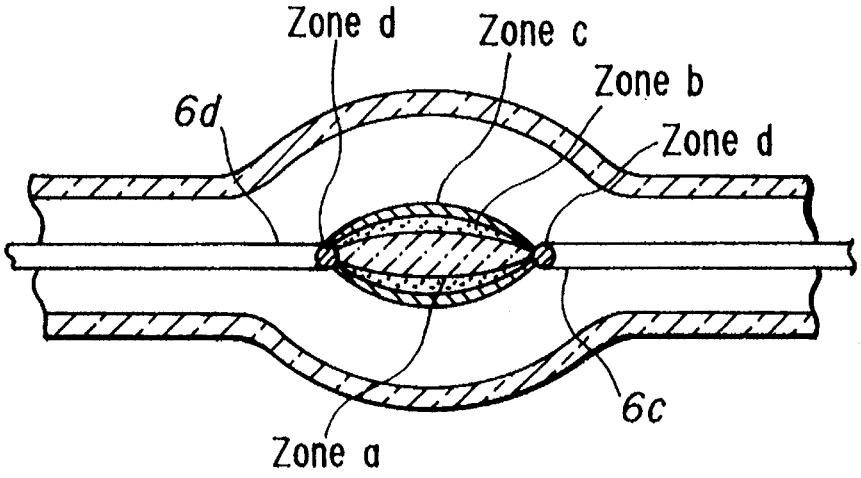
FIG. 2 is an axial sectional view of the essential part of an HID bulb, schematically showing the buildup of discharge arc rays of light.
Figure 3:
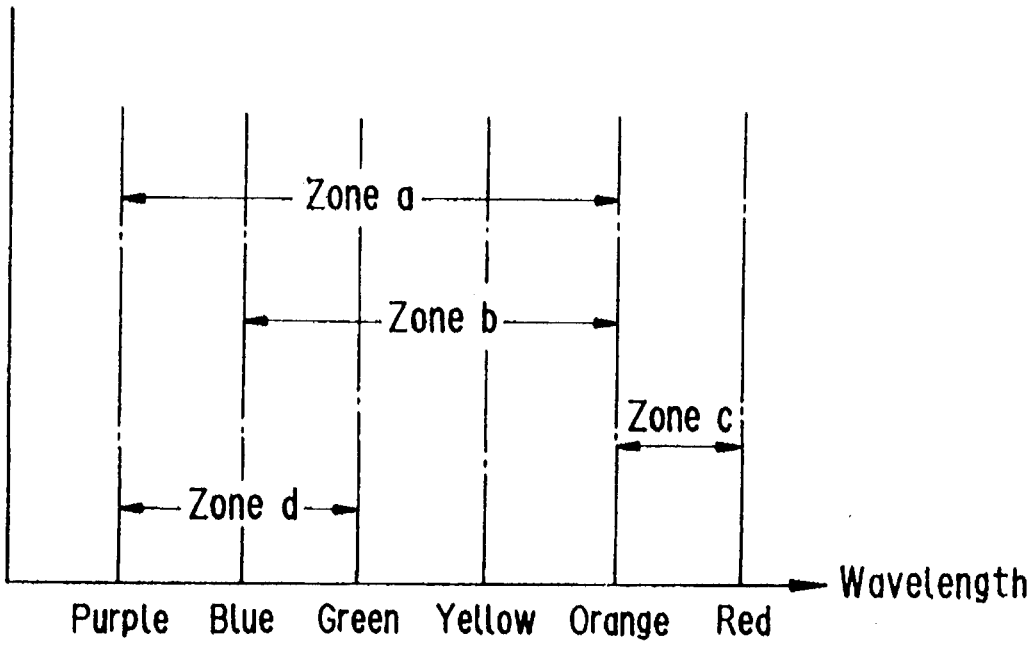
FIG. 3 shows a distribution of wavelengths in the zones a to d in FIG. 2, in which the horizontal axis shows the wavelength with color scales.
Figure 4:
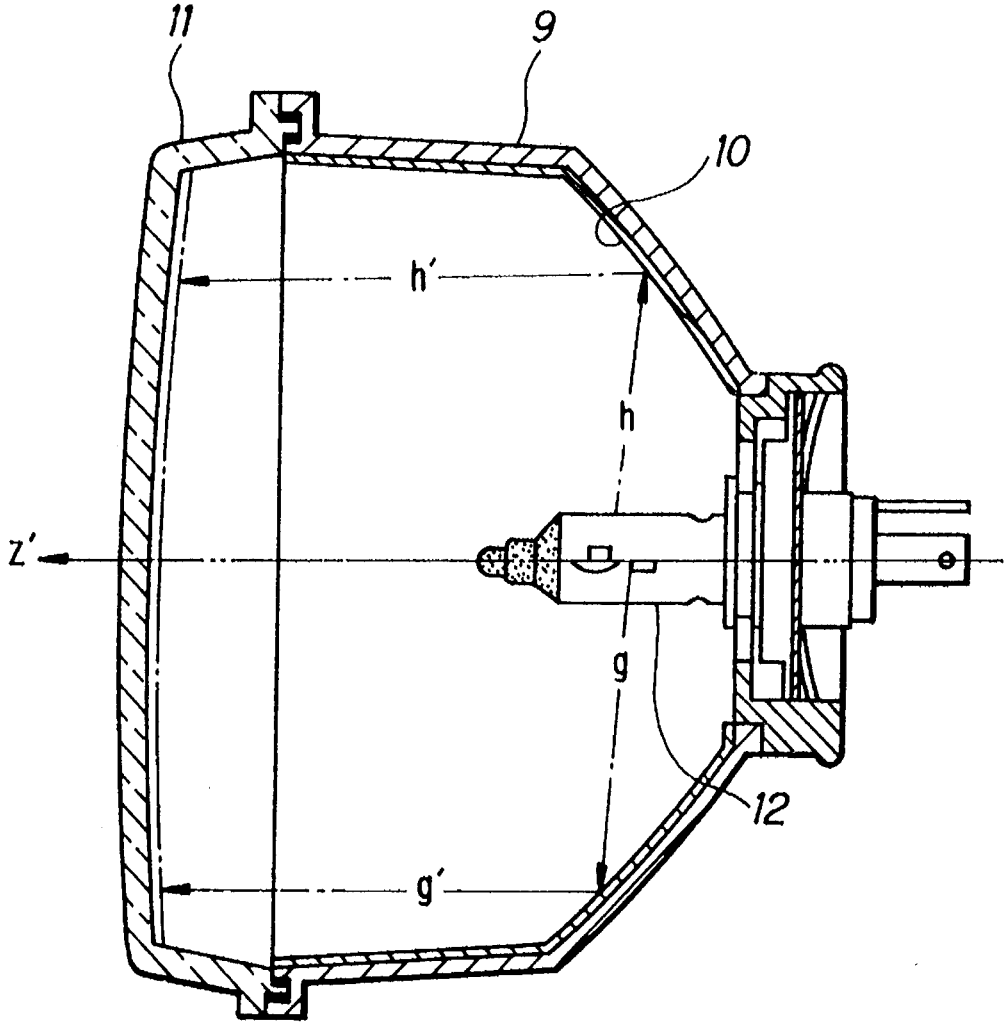
FIG.4 (PRIOR ART)
FIG. 4 is a sectional view of a conventional non-projector type headlight comprising a lamp bulb disposed near the focus of a reflecting surface like a paraboloid of revolution, and a prism lens disposed perpendicular to the path of the rays of light reflected by the reflecting surface.
Figure 5:
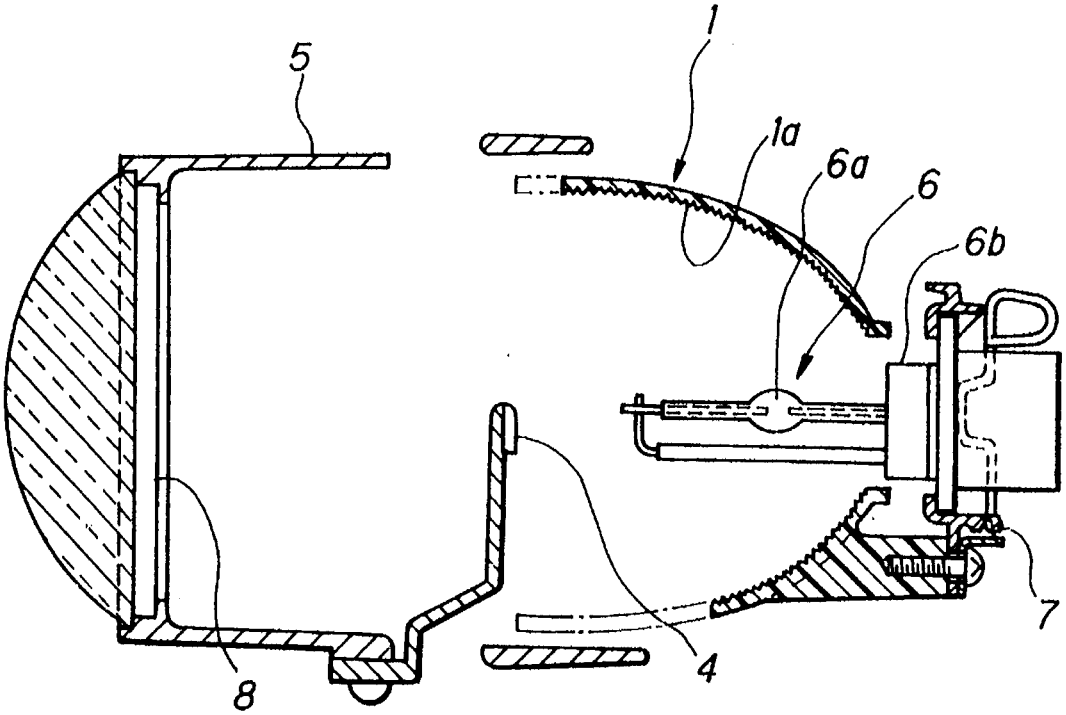
FIG. 5 is a sectional view of an embodiment of the projector type headlight according to the present invention, having a color-suppression structure.

Referring now to FIG. 5, the first embodiment of the projector type headlight according to the present invention will be described structurally and functionally. FIG. 5 is a schematic axial sectional view of the projector type headlight with a color-suppression structure according to the first and second aspects of the present invention. In FIG. 5, many fine convexities are shown as enlarged in scale. As shown, the projector type headlight has a reflector (of a spheroidal mirror, for example) 1 having two focuses F1 and F2, and an HID bulb 6 of which the discharge portion 6*a* is located at the first focus F1 of the reflector 1. The headlight also has a socket 6*b* and socket holder 7. Rays of light emitted due to an arcing within the discharge portion 6*a* are reflected by the reflector 1, partially cut by a shade 4 (as having been described in the foregoing with reference to FIG. 1(B)), converged through a non-spherical convex lens supported by a frame 5 and projected forwardly (to the left of the drawing) of the headlight.

The inner surface of the reflector 1 has many fine convexities l*a* formed in the effective reflecting area thereof. Alternatively, many fine concavities may be formed in place of such convexities to provide a predetermined divergence of the rays of light.

The present invention includes the following three recommendable, but not limitative, methods for forming fine concavities or convexities on the inner surface of the reflector 1. It was revealed through the Applicant's many experiments that all these methods are usable highly effectively and practically for their respective intended purposes.

(a) For molding the reflector 1, a mold having fine concavities or convexities formed thereon is used to form corresponding fine convexities or concavities on the inner wall (which is to be the reflecting area) of the molded reflector. An under-coating is applied to the convexities or concavities, a reflective layer is evaporated thereon and a top-coating is further applied thereto.

(b) A reflector 1 having a smooth inner wall is made by molding. An "under-coating having a property to form fine convexities on the reflector inner wall after curing" is applied to the inner wall of the reflector 1, a reflective layer is evaporated thereon, and a top-coating is further applied thereto.

(c) A reflector 1 having a smooth inner wall is made by molding. A mixture of an under-coating and fine solid grains (powder) is applied to the reflector inner wall, a reflective layer is evaporated thereon, and a top-coating is applied thereto.

The fine concavities or convexities 1*a* thus formed in the effective reflecting area of the reflector 1 appropriately scatter the colored rays of light emitted from the discharge portion 6*a* of the HID bulb 6. The rays of light thus scattered are mixed together to be a white light. The resultant white light is partially cut off by the shade 4 and converged through the non-spherical convex lens 8 to define a predetermined light distribution pattern. However, in case there is no necessity of providing the cut line to the light distribution pattern (for example, if the dazzling of the driver in the car running on the opposite lane may not be taken into consideration), the shade 4 may not be provided in the headlight. Since the rays of light from the HID bulb 6 can be whitened as having been described in the foregoing, the present invention permits to effectively prevent the light distribution pattern from appearing colored unless there is any cause of such coloring (for example, spectral coloring of the rays of light by the non-spherical convex lens 8).

Figure 6:
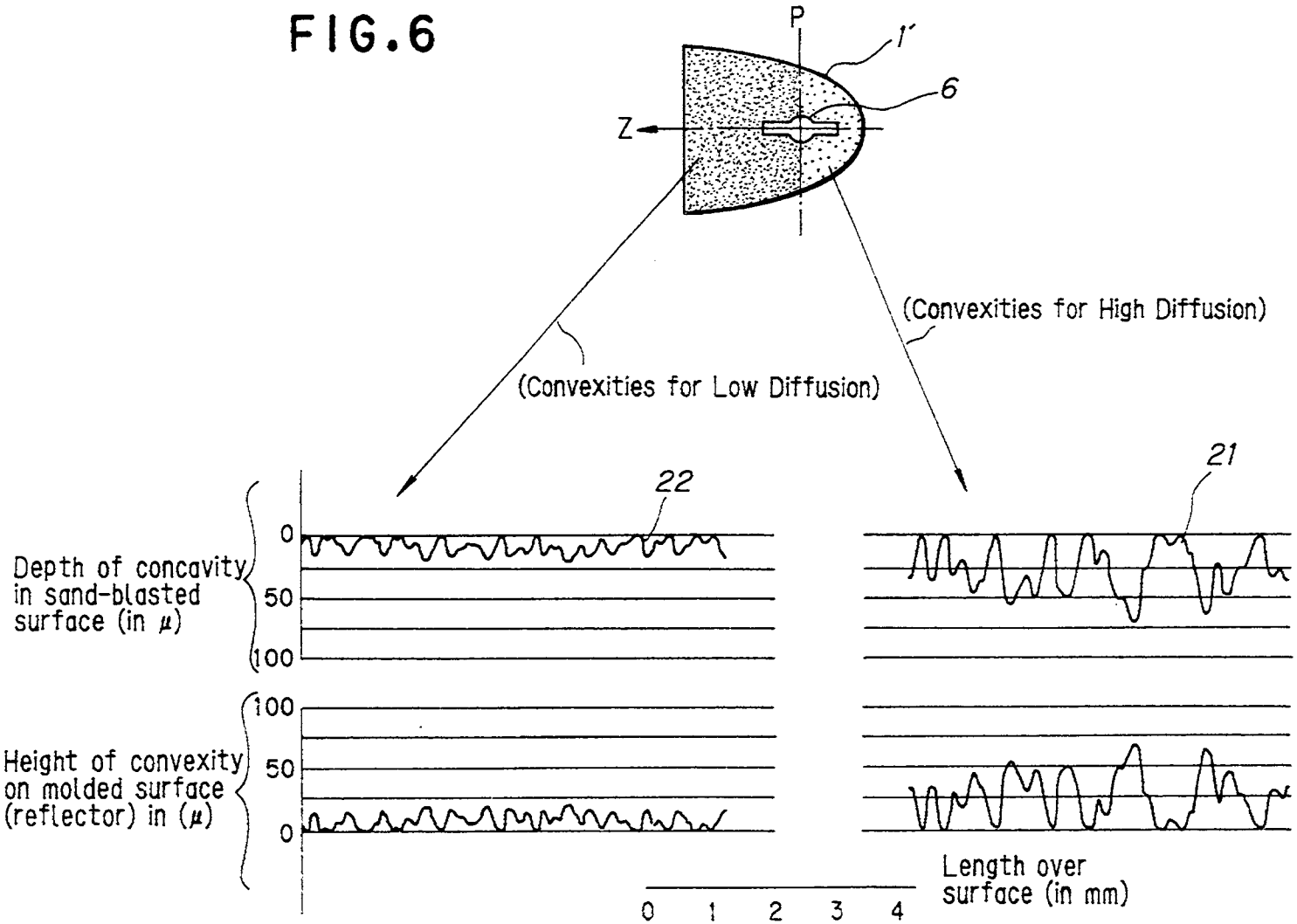
FIG. 6 shows another embodiment of the present invention, in which a projector type headlight comprises a reflector having formed thereon convexities for low light diffusion and those for high light diffusion, and an HID bulb, also showing diagrammatically the shapes and sizes of fine convexities for low light diffusion and those for high light diffusion, corresponding to the schematic section of the reflector in which the optical axis Z lies.

The embodiment of the present invention shown in FIG. 5 has a color-suppression structure designed based on the technical concept that color components of the rays of light are suppressed by them mixing together by scattering. On the other hand, the projector type headlight shown in FIG. 6 is based on a concept that the light distribution pattern is corrected and also colors are suppressed by improving the sizes and distribution of the fine concavities or convexities. FIG. 6 shows a different embodiment from that shown in FIG. 5. FIG. 6 is a sectional view, by a plane in which the optical axis Z lies, of a projector type headlight comprising a reflector on which fine convexities for low light diffusion and those for high light diffusion are formed, and an HID bulb, the reflector being illustrated in combination with a schematic diagram of the shapes and sizes of these fine convexities.

In FIG. 6, the projector type headlight comprises a reflector 1' having a spheroidal reflecting surface having an optical axis Z, and an HID bulb of which the discharge portion (light source) is located at the first focus of the reflector 1'. In FIG. 6, a virtual plane P perpendicular to the optical axis Z passes through the center of the discharge portion. Fine convexities for high light diffusion are formed on a portion of the effective reflecting area of the reflector 1' that is located in the rear of the plane P with respect to the light projecting direction while fine convexities for low diffusion are formed on a portion of the effective reflecting area that is located in front of the plane P. For a predetermined light diffusion in this embodiment, fine concavities are formed, by sand-blasting, on the inner surface of a mold which is used to form a reflector, thereby forming corresponding fine convexities in the effective reflecting area of the molded reflector. Alternatively, however, many fine concavities can be formed, by metal spraying, on the inner surface of a reflector forming mold to form corresponding fine convexities in the effective reflecting area of the molded reflector.

The fine convexities for high light diffusion in this embodiment are indicated generally by a curve 21 in FIG. 6. For microscoping the reflecting surface, the reflector 1' was cut along a plane perpendicular to a plane tangent to an arbitrary point on the spheroidal surface of the reflector 1'. The convexities within a cut length of 1 mm counted approximately 10, and the maximum height of the convexities was approximately 75 microns and average height was approximately 45 microns. The fine convexities for low light diffusion in this embodiment are indicated generally by a curve 22 in FIG. 6. The number of convexities counted within a cut length of 1 mm was approximately 15, and the maximum height of the convexities was approximately 20 microns and average height was approximately 15 microns. However, the surface roughness by machining is not always proportional to the "light diffusion" as optical characteristic. There is no definite correlation between them.

Figure 7:
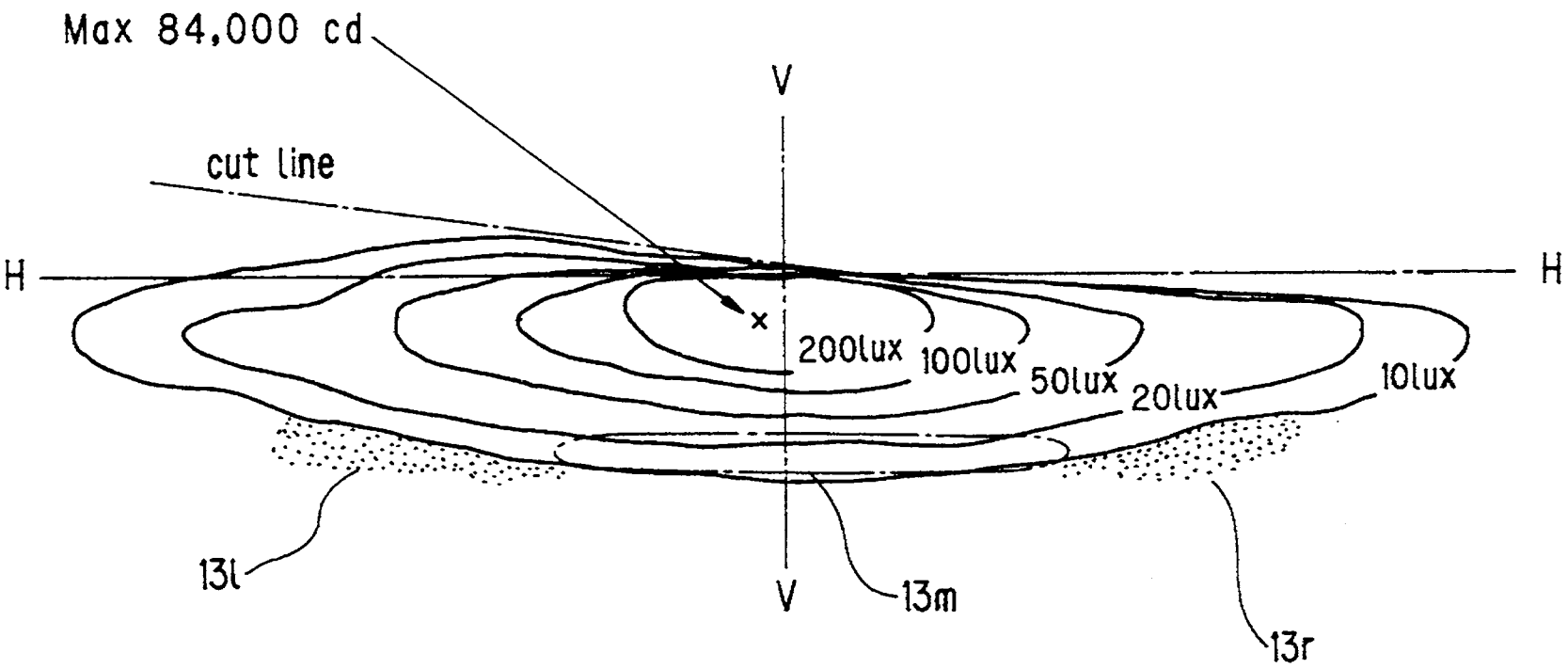
FIG. 7 shows a light distribution pattern defined by the rays of light projected from a conventional projector type headlight using an HID bulb as light source, to which the effect of the present invention will be described with reference.

FIG. 7 shows a light distribution pattern defined by the rays of light from a conventional projector type headlight using a HID bulb as light source, to further explain the present invention in comparison with the prior art.

The light distribution pattern is defined by a conventional projector type headlight constructed for a car driving following the traffic rules for left-way traffic. The half to the left of the V—V line is a left lane while the right half is a lane for a car running in the opposite direction (right lane). A maximum luminous intensity spot, called "hot zone", exists near the center (indicated with "x") of the pattern, the luminous intensity being equal to 84,000 cd. An equiluminous curve of 200 lx is formed around the hot zone, and further equiluminous curves of 100 to 10 lx are formed one after another outwardly of the hot zone. For the convenience of explanation, it is assumed that the 10-lx equiluminous curve is the outer circumference of the illuminated area.

In the lane on which a car is running in the opposite direction (right half of the pattern), the illuminated area is precisely under the horizontal H—H. This is because the upper edge of the rays of light from the headlight is cut off by the shade as having previously been described with reference to FIG. 1(B). Thus, since the upper edge is cut off by the shade, the color components which would otherwise appear around the illuminated area do not appear as colored zones. As a result, a left-hand color zone 131 appears in the left lower area while a right-hand color zone 13*r* appears in the right lower area, as shown in FIG. 7. Also there is a zone 13*m* indicated with a virtual line in FIG. 7, which contains color components when spectrally analyzed. However, this zone 13*m* is enclosed in the illuminated area (indicated with a 10-lx equiluminous curve) and therefore cannot be sensed as colored.

Figure 8:
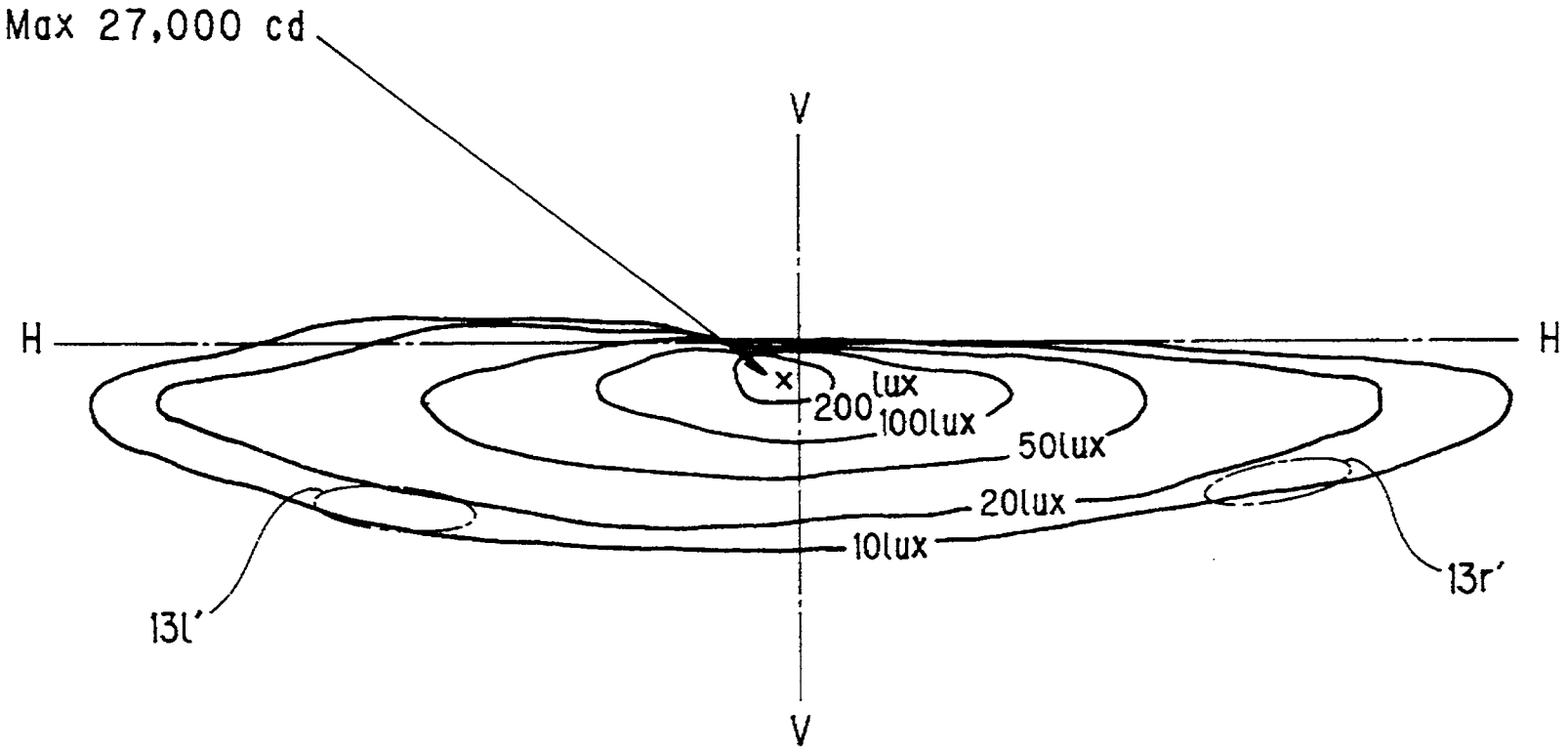
FIG. 8 shows a light distribution pattern formed from a group of equiluminous curves when rays of light are projected onto a screen from the projector type headlight according to the present invention, shown in FIG. 6.

FIG. 8 shows a light distribution pattern of equiluminous curves, defined on a screen when rays of light are projected from the projector type headlight shown in FIG. 6. This pattern also has a hot zone along with the colored zones in FIG. 7 indicated with virtual lines, respectively.

In the light distribution pattern shown in FIG. 7, the hot zone is formed by the rays of light reflected mainly in the central area of the reflector. In the light distribution pattern shown in FIG. 8, however, the hot zone has 27,000 cd and the 200-lx equiluminous curve is extremely small as compared with that in FIG. 7 because of the fine convexities for high light diffusion formed in the central area of the reflector. The diffusion of the reflected rays of light results in an enlargement of the outer circumference (10-lx equiluminous curve) of the illuminated area. Thus, the hot zone near the center of the pattern is reduced in luminous intensity, the illuminated area is increased, and the light distribution pattern as a whole is wider.

The pattern in FIG. 8 also has zones 13*l*' and 13*r*' corresponding to the colored zones 131 and 13*r* in FIG. 7. However, since they are enclosed within the outer circumference (10-lx equiluminous curve) of the illuminated area, whitening by mixing of colors and color suppression by superposition with white light (namely, no colors are sensed by the human eyes) work in cooperation with each other to prevent colored appearance of the rays of light substantially perfectly in practice.

In the embodiment shown in FIG. 6, the high-diffusion reflecting area in the rear of the virtual plane P and low-diffusion reflecting area in front of the plane P, lower the luminous intensity in the hot zone and widen the light distribution pattern as a whole as shown in FIG. 8. However, the extent of light diffusion and distribution of high and low diffusion areas may be combined in various manners. Although the effective reflecting area to the left of the plane P is entirely made as a low diffusion one in the above-mentioned embodiment, it may be formed from a combination of high-diffusion reflecting areas and smooth reflecting areas (no-diffusion area) laid like stripes or alternately, for example.

Figure 9:
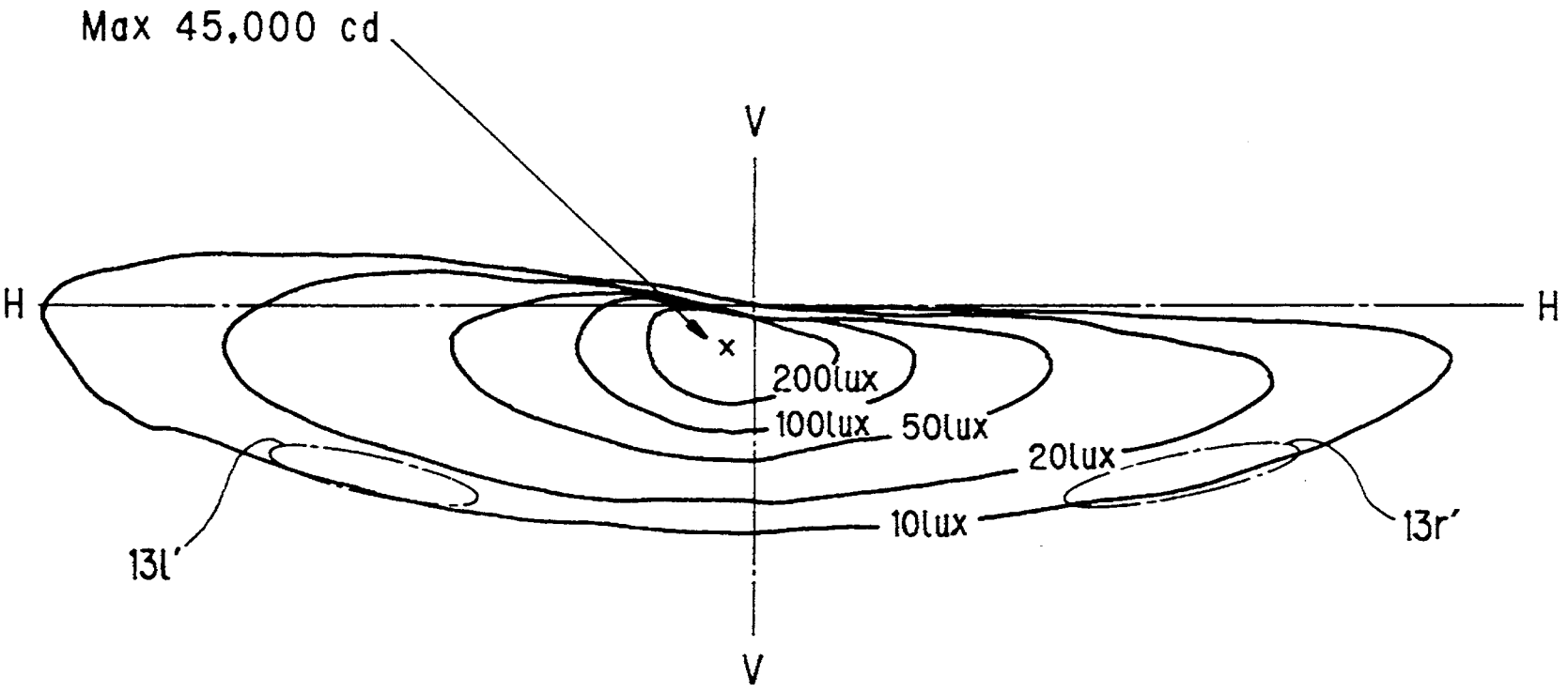
FIG. 9 shows a light distribution pattern defined by rays of light projected from a projector type headlight according to a yet another embodiment of the present invention, having a color-suppression structure.

FIG. 9 shows a light distribution pattern defined by the projector type headlight having a color-suppression structure according to the still another aspect of the present invention.

This projector type headlight has a reflecting area of nearly a same low light diffusion over, or on a portion of, the effective reflecting area of the reflector. The "low-diffusion reflecting area" referred to here means the light diffusion area shown in the left half of FIG 6.

In the embodiment shown in FIG. 6, since the high-diffusion reflecting area is formed in the center of the reflector (in the rear of the virtual plane P), the luminous intensity at the center of the light distribution pattern is lowered to 27,000 cd as shown in FIG. 8. However, this embodiment (of which the light distribution pattern is shown in FIG. 9) has only a low-diffusion reflecting area over the effective reflecting area of the reflector, so that the central portion of the effective reflecting area presents no high diffusion of the rays of light. Thus the maximum luminous intensity is maintained at 45,000 cd (as in FIG. 9). Although this luminous intensity is nearly a half of that in the conventional projector type headlights (in FIG. 7), the central portion appears as a high intensity spot. The 200-lx equiluminous curve is smaller than that in the conventional projector type headlight as in FIG. 7 but still larger than that in the embodiment shown in FIG. 8 (in which a high-diffusion reflecting area is formed in the rear of the virtual plane P).

Also in this embodiment (of which the light distribution pattern is shown in FIG. 9), the illuminated area (10-lx equiluminous curve) is enlarged and encloses therein the aforementioned zones 13*l*' and 13*r*' (which would be colored in case of the conventional projector type headlights), thus the colors are not sensed by the human eyes. This owes to the synergism between the previously mentioned two principles (b) When rays of light in variety of colors are mixed through diffusion and reflection, a nearly white color will result and (a) When a strong white light (white light distribution pattern of 10 to 20 lx in this embodiment) is superposed on this almost white color light, the human eyes will sense no colors in the rays of light. Both these principles (a) and (b) can be realized by forming many fine concavities or convexities in the effective reflecting area of the reflector.

As apparent to those skilled in the art from comparison of the above embodiments, there may be formed between the low- and high-diffusion reflecting areas an area offering a medium diffusion or reflecting areas of various diffusion may be formed in combination of the effective reflecting area.

Figure 10:
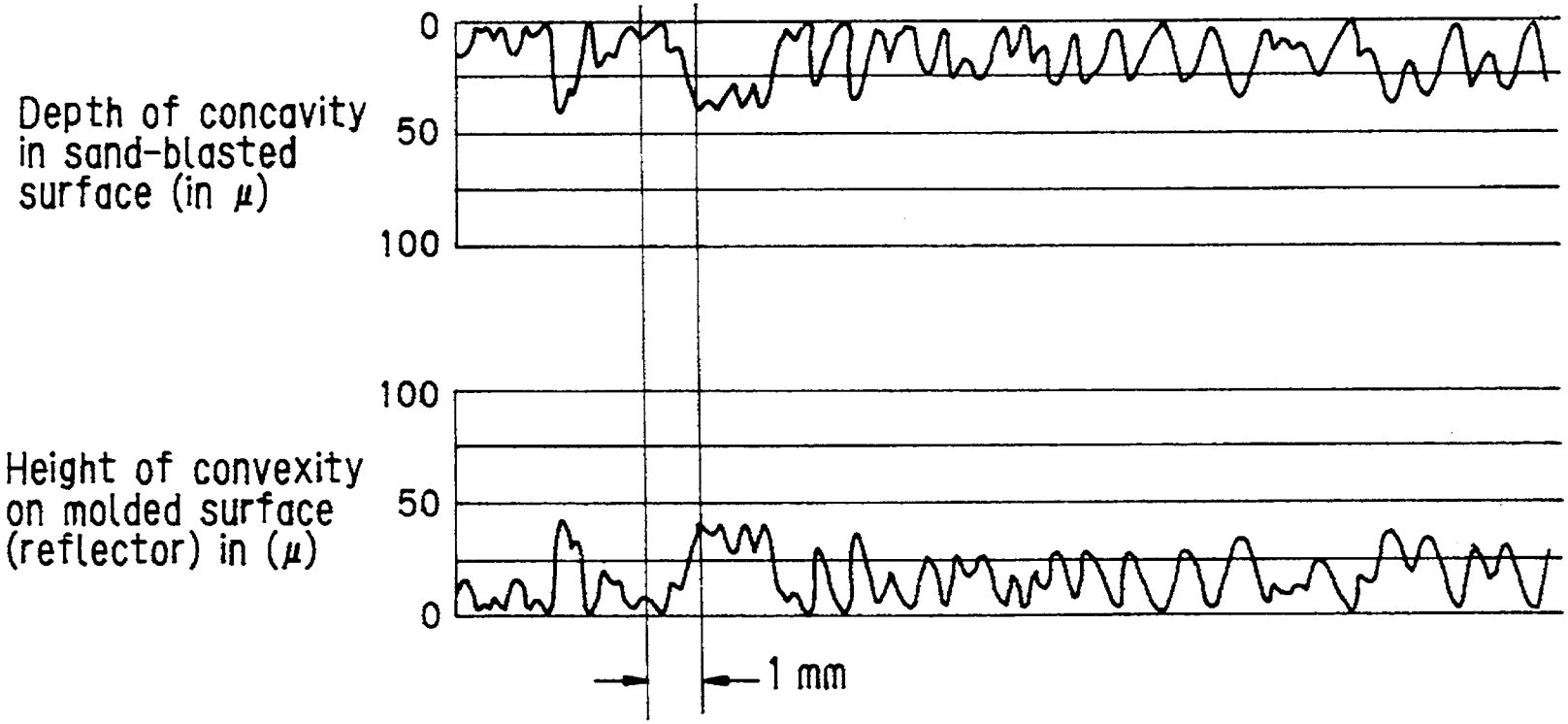
FIG. 10 is a diagram of the shapes and sizes of fine convexities located in the intermediate area between the convexities for low light diffusion and those for high light diffusion shown in FIG. 6 and which diffuse the rays of light to a medium extent.

FIG. 10 shows the shapes and sizes of the fine convexities formed on the intermediate portion between the low- and high-diffusion fine convexities shown in FIG. 6 and which diffuse rays of light to a medium extent. The scales of the horizontal and vertical axes in FIG. 10 are the same as those in FIG. 6.

The convexities in FIG. 10 is just an example, and the reflecting area of the reflector can be adapted to provide light diffusion to various extents. The light diffusion may be set to freely vary the light distribution between those shown in FIGS. 8 and 9. Also, the light diffusion by the convexities may be so set as to vary the light distribution pattern between those shown in FIGS. 9 and 7 (showing a light distribution pattern defined by the rays of light from a conventional projector type headlight).

The present invention can be embodied in various forms. It is possible to meet various given design requirements by providing various light distribution patterns (spot-like or wide, for example) while maintaining the effect of color suppression). Further, the projector type headlight according to the present invention can be manufactured with only a small addition of the costs because of the simple structure Oust forming of the fine convexities or concavities in the effective reflecting area of the reflector). In case the fine convexities or concavities are formed in the effective reflecting area of the reflector by molding using a mold in which corresponding fine concavities or convexities are formed, the running costs for mass production of such reflector will not increase only with a slight increase of the initial costs for preparation of the molds. Furthermore, the present invention permits to maintain the interchangeability of the components of a projector type headlight with those of another according to the present invention since many fine concavities or convexities are only formed in the effective reflecting area of the reflector.

What is claimed is:

1. A projector type headlight comprising:

a reflector having two focuses, an HID bulb of which a discharging portion is located near a first one of the two focuses, and a convex lens which converges rays of light emitted from the HID bulb and reflected by the reflector, said reflector having formed in the center of an effective reflecting area thereof many fine concavities or convexities for diffusing and reflecting the rays of light, wherein with a virtual plane P perpendicular to the optical axis Z set so as to pass through the center of the discharging portion, a portion of the many fine concavities or convexities are formed for a predetermined light diffusion on a portion of the effective reflecting area located in the rear of said plane P with respect to the light projecting direction while a portion of the many fine concavities or convexities for a lower diffusion are formed on a portion of said effective reflecting area that is located in front of said plane P.

2. A projector type headlight comprising:

a reflector having two focuses, an HID bulb of which a discharging portion is located near a first one of the two focuses, and a convex lens which converges rays of light emitted from the HID bulb and reflected by the reflector, said reflector having formed in the center of an effective reflecting area thereof many fine concavities or convexities for diffusing and reflecting the rays of light, wherein with a virtual plane P perpendicular to the optical axis Z set so as to pass through the center of the discharging portion, a portion of the many fine concavities or convexities are formed for a predetermined light diffusion on a portion of said effective reflecting area located in the rear of said plane P with respect to the light projecting direction while a smooth surface is formed over, or on a portion of, said effective reflecting area that is located in front of said plane P.

3. A projector type headlight, comprising:

a reflector having first and second focuses;

an HID bulb having a discharging portion located near the first focus;

a shade provided near the second focus for cutting off part of rays of light emitted from the HID bulb and reflected by the reflector; and a convex lens converging and projecting the rays of light passing through the shade, said reflector having many fine concavities or convexities formed in a substantially entire effective reflecting area thereof, each of the concavities or convexities provided with a nearly same diffusion characteristic such that colored rays of light emitted from the HID bulb are suppressed without affecting the formation of a light distribution pattern.

* * * * *